US005436052A

United States Patent [19]

Basse et al.

[11] Patent Number: 5,436,052

[45] Date of Patent: Jul. 25, 1995

[54] NET, ESPECIALLY A SPACING NET OR SURFACE PROTECTION NET

[75] Inventors: Hartwig Basse, Nordenham; Hans-Joachim Bittner, Brake, both of Germany

[73] Assignee: Norddeutsche Seekabelwerke, Nordenham, Germany

[21] Appl. No.: 24,438

[22] Filed: Mar. 1, 1993

[30] Foreign Application Priority Data

Mar. 5, 1992 [DE] Germany ..... 42 06 893.2

[51] Int. Cl.[6] ..... B32B 5/12

[52] U.S. Cl. ..... 428/109; 428/105; 428/107; 428/110; 428/255

[58] Field of Search ..... 428/105, 107, 109, 110, 428/255

[56] References Cited

U.S. PATENT DOCUMENTS

| | | | |
|---|---|---|---|
| 3,011,820 | 12/1961 | Frieder | 294/77 |
| 4,241,123 | 12/1980 | Shik | 428/107 |
| 4,460,633 | 7/1984 | Kobayashi et al. | 428/105 |
| 4,741,442 | 5/1988 | Slocomb | 428/255 |

FOREIGN PATENT DOCUMENTS

| | | |
|---|---|---|
| 17982 | 4/1963 | Luxembourg . |
| 1821 | of 1910 | United Kingdom . |
| 839527 | 6/1960 | United Kingdom . |

*Primary Examiner*—James J. Bell

*Attorney, Agent, or Firm*—Burns, Doane, Swecker & Mathis

[57] ABSTRACT

Disclosed is a net (10), especially a spacing net, surface protection net or the like, in which the strands (14, 15, 16) are arranged in three planes (11, 12, 13), and in which the strands (15, 16) of two planes (11, 13) are oriented equidirectionally. As a result, a sufficient thickness of the net (10) can be ensured with a small cross section of the individual strands (14, 15, 16), which keeps the expenditure of material down to a minimum. Because the parallel strands (outer strands 15, 16) of the different outer planes (11, 13) are offset to one another in the direction of the inner strands (14), the intermediate strands (inner strands 14) can be deformed elastically, which results in very good padding properties and thickness variation properties of the net (10).

23 Claims, 3 Drawing Sheets

NET, ESPECIALLY A SPACING NET OR SURFACE PROTECTION NET

BACKGROUND OF THE INVENTION

The invention relates to a net, especially a spacing net, surface protection net or the like, having strands which intersect one another.

The nets mentioned above are mainly used as spacing nets or protective nets for highly finished surfaces. They are formed from two layers of strands which intersect one another. For the purpose of pack aging goods in a safe manner or spacing apart articles, it is required that the net has a certain thickness. In prior art nets, the strands are provided with a cross section of appropriately great dimension to meet thickness requirements. These type of nets require a high expenditure of material. Besides, they only have a very limited resilience.

SUMMARY OF THE INVENTION

It is, therefore, the object of the invention to provide a net of the species described in the foregoing which meets especially the spacing and surface protection requirements.

According to the invention, this object is accomplished by arranging the strands of the net in three different planes and orienting the strands of two planes equidirectionally. As a result, a relatively great thickness of the net is obtained with a small cross section of the individual strands (minimum expenditure of material), and the resilience of the net is improved.

Preferably, the strands of two outward planes (outer strands) extend parallel to one another, so that the outer strands do not cross one another, and a uniform thickness of the net is ensured.

In a special embodiment of the invention, the outer strands of the outer p lanes extend parallel and are offset to one another in the longitudinal direction of the strands (inner strands) of the median plane. This results in a surprisingly good resilience of the net.

It is of advantage that especially the inner strands are elastically deformable in such a way that the outer strands are movable in the direction of the median plane of the inner strands. When the outer strands are subjected to stress in the direction towards the median plane and thus towards the inner strands, the outer strands shift, so to speak, into the median plane, that is to say between the inner strands. The good resilience of the net is a result of the elastic deformation of at least the inner strands. In the end, it is thus ensured that the goods enclosed in the netting are well padded, or that the distance between two articles which are separated by the net can be varied.

The resilience of the net depends in particular on the distance by which the outer strands of different outer planes are offset relative to one another in the longitudinal direction of the inner strands. This is why said distance is accurately defined in accordance with the invention. The relation is such that, the smaller the distance between the outer strands of different planes, the firmer the springiness.

If the distance between the outer strands in different planes equals half of the distance between two adjacent strands in one plane, as it is provided in accordance with a special embodiment, the springiness of the net is particularly soft. Of course, this is the case especially when the distances between adjacent outer strands are equal in both outer planes.

It is in particular accordance with the invention to use the net as a spacing means between plate-like articles, especially plates of latent heat storage devices. The thickness of the se plates changes in response to temperature variations. The resulting changes of the distance between the plates can be compensated by the net according to the invention because it is able, as a result of its design in accordance with the invention, to elastically change its thickness to the extent necessary.

Further features of the invent ion and their advantages will be apparent from the dependent claims and the description of the drawings.

BRIEF DESCRIPTION OF THE DRAWINGS

The invention will be described hereinafter, in detail, with reference to several preferred exemplary embodiments and the accompanying drawings, in which.

DETAILED DESCRIPTION OF THE PREFERRED EMBODIMENTS

Figure 1:
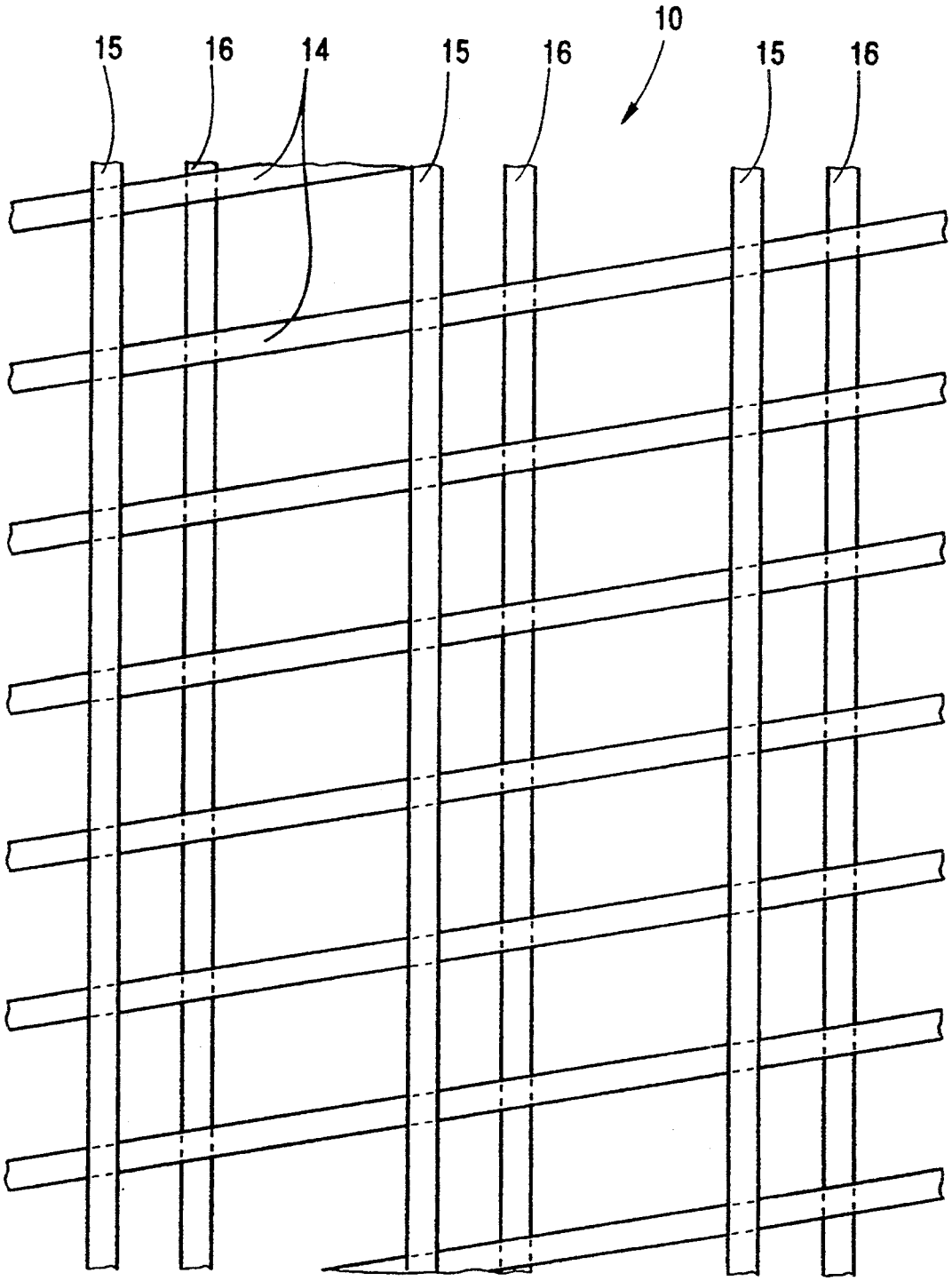
FIG. 1 is a fragmentary schematic and enlarged top plan view of a net.
Figure 2:
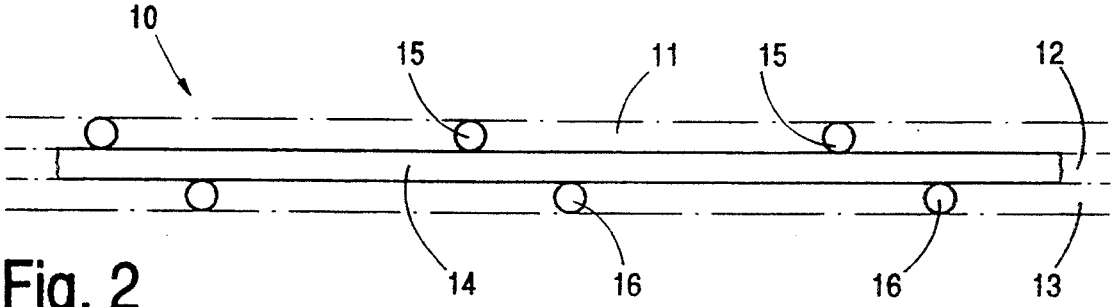
FIG. 2 is a side view of the net of FIG. 1.
Figure 3:
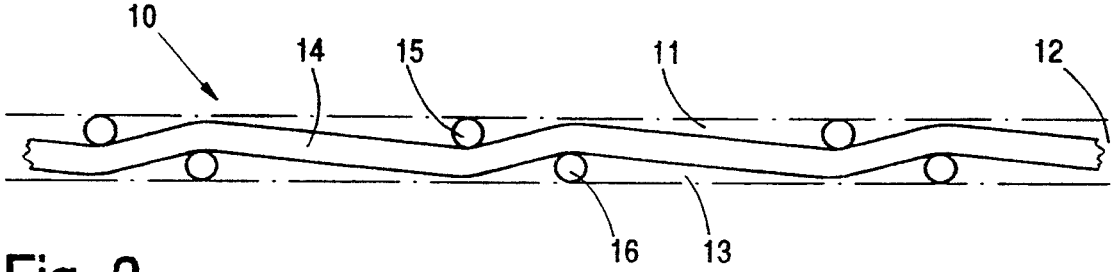
FIG. 3 is a side view of the net of FIG. 1 which is deformed resiliently.

A net 10 which is illustrated in FIGS. 1 to 3 has three different planes 11, 12, 13 which are indicated by dash-dot lines in the Figures. These planes 11, 12, 13 extend parallel to one another. The outer planes 11, 13 are arranged on opposite sides of the median plane 12.

The inner strands 14 extend essentially in an equally spaced relationship in the median plane 12, whereas the outer strands 15, 16 are arranged in the outer planes 11, 13 so as to extend equidirectionally. As is particularly evident from FIG. 1, the outer strands 15, 16 intersect the inner strands 14, preferably at an angle which is less or greater than 90°, especially at an angle of 75°. The outer strands 15, 16 are connected to the inner strands 14 at the points of intersection.

The outer strands 15, 16 are distributed over the outer planes 11, 13. The outer strands 15 in the plane 11 extend parallel to one another, just like the outer strands 16 in the plane 13. Within every plane 11, 12, 13, the inner strands 14 or outer strands 15, 16 are spaced out at equal distances. The outer strands 15 and 16 of the different outer planes 11 and 13 are oriented to extend parallel.

The inner strands 14 and the outer strands 15, 16 extend in an essentially rectilinear manner which is favourable with respect to manufacture of the net and with respect to the mechanical properties of the net 10. As a result, the net 10 exhibits a good stability when it .is subjected to a pulling force in the direction of the outer strands 15, 16 or inner strands 14.

Figure 4:
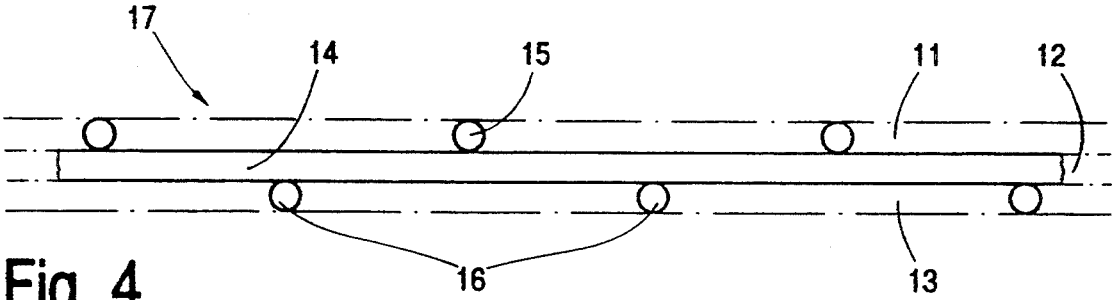
FIG. 4 is a side view of a second exemplary embodiment of the net.
Figure 5:
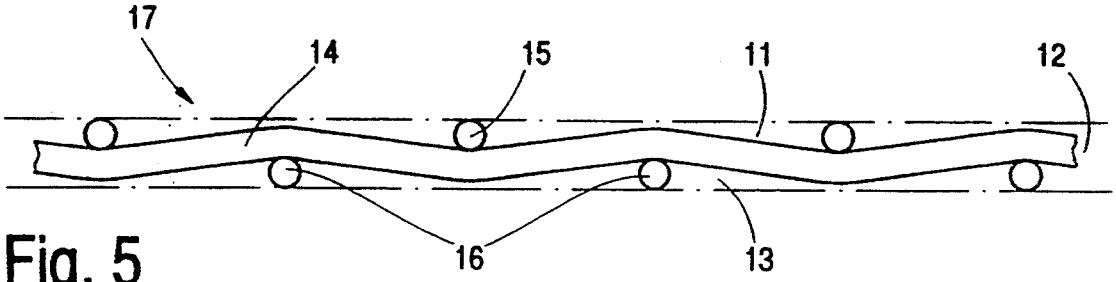
FIG. 5 is a side view of the net of FIG. 4 which is deformed resiliently.

In the exemplary embodiments of FIGS. 1 to 7, the parallel outer strands 15, 16 of the different outer planes 11, 13 are disposed offset to one another in the longitudinal direction of the inner strands 14. This is particularly important for the resilience of the net 10. A force which is exerted on the outer strands 15 of the outer plane 11 in the direction towards the plane 12 effects a relative movement of the outer strands 15, 16 and a deformation of the inner strands 14. The outer strands 15, 16 move in the direction of the inner strands 14 while, at the same time, the inner strands 14 are deformed elastically, such that they extend .in a wave-like manner (FIGS. 3 and 5). As a result of this relative movement, the outer planes 11, 13 and the central plane 12 overlap, so to speak. In other words, the outer planes 11, 13 move towards one another and rest against one another when the net 10, 17, 18, 19 assumes a "blocked" position in which it can not be compressed any further.

FIGS. 3 and 5 illustrate the relative movement of the net 10, 17 when it is subjected to stress between two plane surfaces which are not shown. In these Figures, the net 10, 17 is in an almost "blocked" position, in which the distance between said surfaces equals the sum of the diameters of two strands (inner strands 14 or outer strands 15, 16). The resilience of the net 10 essentially depends on the distance by which the outer strands 15 of the outer plane 11 are offset relative to the outer strands 16 of the outer plane 13. In the case of a small distance (see FIGS. 1 to 3), the springiness of the net 10 is relatively firm.

If, on the other hand, the distance between the outer strands 15, 16 of different outer planes 11, 13 is greater, specifically if the outer strands 15 or 16 of the one plane 11 or 13 are evenly staggered relative to the outer strands 15 or 16 of the other outer plane 11 or 13, as in the exemplary embodiment of FIGS. 4 and 5, the springiness of a net 17 is soft.

In accordance with the invention, the appropriate definition of this distance alone makes it possible to essentially control the resilience of the net. For this purpose, it would also be possible to arrange the outer strands 15, 16 within the outer planes 11, 13 in a way which is different to the ones illustrated in the drawings.

Figure 6:
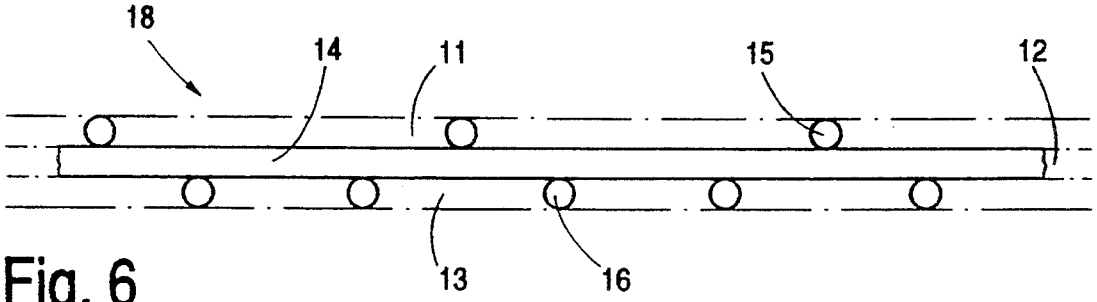
FIG. 6 is a side view of a third exemplary embodiment of the net.

In the exemplary embodiment of FIG. 6, the distances between the outer strands 15 and 16 of the respective outer plane 11 or 13 are equal, but the outer plane 13 has twice as many strands 16 as the outer plane 11. The distances between the outer strands 16 of the outer plane 13 are defined such that two of the outer strands 16 of the outer plane 13 are always disposed between two adjacent outer strands 15 of the outer plane 1. In this exemplary embodiment of a net 18, the inner strands 14 are also deformed in a wave-like manner when the net is subjected to stress, but the deformation of the inner strands 14 about the outer strands 15 is greater than the deformation of the inner strands 14 about the outer strands 16. The springiness of a net 18 having this design is firmer than in the exemplary embodiments described in the foregoing.

Figure 7:
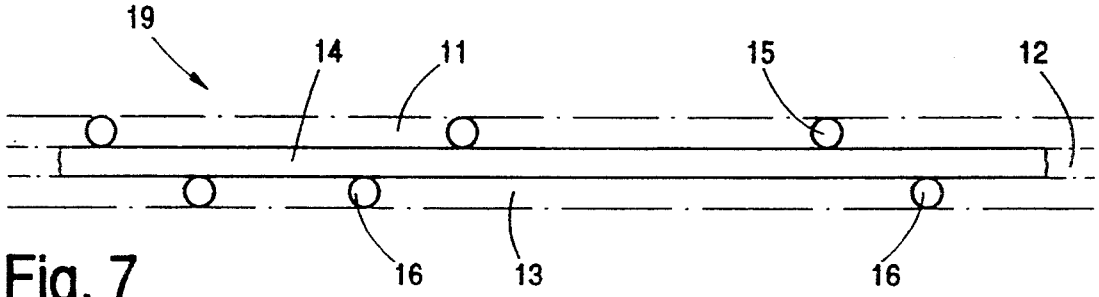
FIG. 7 is a side view of a fourth exemplary embodiment of the net.

In a net 19 which is illustrated in FIG. 7, the distances between the outer strands 16 of the outer plane 13 are changed in such a way that, alternately, two of the outer strands 16 are disposed between two of the adjacent outer strands 15 of the outer plane 11, whereas the outer plane 13 does not have any outer strands 16 in the region between the following two outer strands 15 of the outer plane 11. The resilience of this net 19 varies in places, such that the springiness is firmer in those regions where the outer strands 16 are disposed between the outer strands 15.

Figure 8:
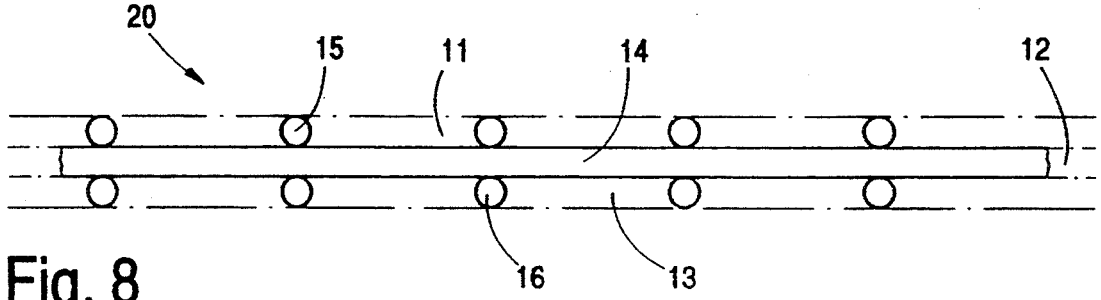
FIG. 8 is a side view of a fifth exemplary embodiment of the net.

In a net 20 which is illustrated in FIG. 8, the outer strands 15 and outer strands 16 also extend equidirectionally or parallel to one another, but they are located opposite one another in an essentially congruent manner, i.e. they are not offset in the longitudinal direction of the inner strands 14. This net 20 has only a small resilience, but it permits a constant and relatively great distance between the goods or articles which have to be spaced apart, even though the individual outer strands 15, 16 and inner strands 14 have a small diameter.

The outer strands 15, 16 and inner strands 14 of the illustrated nets 10, 17, 18, 19 and 20 preferably have circular cross sections of equal size. However, the cross section of the inner strands 14 may be greater or smaller than the cross section of the outer strands 15, 16 in order to vary the resilience. In this case the relation is such that, the greater the cross section of the inner strands 14, the firmer the springiness, and vice versa. The outer strands 15, 16 and/or inner strands 14 could also be provided with other cross sections (for example square, elliptic or other cross sections).

The nets 10, 17, 18, 19 and 20 have a tubular design. The tubular nettings 10, 17, 18, 19 and 20 are easy to pull over the goods which are to be protected or over the articles, especially plates, which have to be spaced apart. When the nets 10, 17, 18, 19 and 20 are used as protective nettings for highly finished surfaces, it is above all the three-layer design of the net which ensures a reliable protection of the goods against damage. The tubular nettings 10, 17, 18 and 19, whose thickness can be varied elastically, also offer a good padding for the goods which are enclosed in the net. When the tubular nettings 10, 17, 18, 19 are used as spacing means between heat storage plates of latent heat storage devices, the elastic resilience serves for compensating for the changes in the thickness of the heat storage plates caused by temperature variations. For this purpose, the nets 10, 17, 18 or 19 are compressed when the thickness of the heat storage plates increases.

Especially when the nets 10, 17, 18, and 19 are used as spacing means for heat storage plates, the mesh pattern of the outer strands 15 and 16 of the two outer planes 11, 13 is such that they always extend adjacent to the corners or edges of the heat storage plates. This ensures a secure and non-slip grip of the tubular nettings 10, 17, 18, or 19 on the heat storage plates.

We claim:

1. A net, especially a spacing net or surface protection net, having strands which intersect one another, wherein the strands are arranged in more than two planes (11, 12, 13) and the strands of at least two planes (11, 13) extend equidirectionally.

2. The net as claimed in claim 1, wherein the strands which form outer strands (15, 16) of two outward planes (11, 13) extend parallel to one another.

3. The net as claimed in claim 1, wherein the outer strands (15, 16) are arranged in parallel outer planes (11, 13) on opposite sides of a median plane (12).

4. The net as claimed in claim 2, wherein the outer strands (15, 16) are distributed over the two outer planes (11, 13).

5. The net as claimed in claim 2, wherein the outer strands (15, 16) of different outer planes (11, 13) are offset to one another in the longitudinal direction of the strands (inner strands 14) of the median plane (12).

6. The net as claimed in claim 2, wherein the strands which form inner strands (14) between the outer strands (15, 16) are spaced at equal distances.

7. The net as claimed in claim 2, wherein at least the inner strands (14) are deformable elastically in such a way that the outer strands (15, 16) are shiftable in the direction towards the median plane (12) of the inner strands (14).

8. The net as claimed in claim 7, wherein the outer strands (15, 16) of different outer planes (11, 13) are offset to one another by a defined distance, in accordance with the required springiness resulting from a deformation of the inner strands (14).

9. The net as claimed in claim 2, wherein the outer strands (15, 16) of the one outer plane (11 or 13) are offset by a distance which corresponds to half the distance between two adjacent outer strands (15, 16) of the other outer plane (11 or 13).

10. The net as claimed in claim 2, wherein the outer strands (15, 16) in the two outer planes (11, 13) are spaced at equal distances.

11. The net as claimed in claim 2, wherein the one outer plane (11 or 13) has a greater number of outer strands (15, 16) than the other outer plane (11 or 13).

12. The net as claimed in claim 2, wherein the distance between the outer strands (16) in the one plane (13) is irregular, such that between two adjacent outer strands (15) of the one plane (11) there are always disposed two adjacent outer strands (16) of the other plane (13).

13. The net as claimed in claim 2, wherein between respective adjacent outer strands (15) of one plane (11), the other plane (13) has alternately either at least one outer strand (16) or no outer strand (16).

14. The net as claimed in claim 6, wherein the outer strands (15, 16) and preferably the inner strands (14) have a circular cross section, and wherein especially the diameter of the outer strands (15, 16) is equal to the diameter of the inner strands (14).

15. The net as claimed in claim 6, wherein the outer strands (15, 16) and inner strands (14) extend in a rectilinear manner.

16. The net as claimed in claim 6, wherein the outer strands (15, 16) and/or inner strands (14) extend in a wave-like, zigzag-like or curved manner.

17. The net as claimed in claim 6, wherein the inner strands (14) extend at an angle relative to the outer strands (15, 16) which is not equal 90°.

18. The net as claimed in claim 2, wherein the net has a tubular design, and wherein the outer strands (15, 16) extend essentially in the longitudinal direction of the tube.

19. The net as claimed in claim 18, wherein the outer strands (15, 16) are arranged in such a way that they are positioned adjacent to the outer edges of goods which are to be enclosed in the net.

20. The net as claimed in claim 2, wherein the outer strands (15, 16) and preferably the inner strands (14) have a circular cross section, and wherein especially the diameter of the outer strands (15, 16) is equal to the diameter of the inner strands (14).

21. The net as claimed in claim 2, wherein the outer strands (15, 16) and inner strands (14) extend in a rectilinear manner.

22. The net as claimed in claim 2, wherein the outer strands (15, 16) and/or inner strands (14) extend in a wave-like, zigzag-like or curved manner.

23. The net as claimed in claim 2, wherein the inner strands (14) extend at an angle relative to the outer strands (15, 16) which is not equal 90°.

* * * * *